United States Patent [19]

Okuno et al.

[11] Patent Number: 4,534,561

[45] Date of Patent: Aug. 13, 1985

[54] TILE ARRANGING APPARATUS FOR AUTOMATIC GAME PLAYING TABLE

[75] Inventors: Toshinori Okuno; Hiroshi Nakamura, both of Saitama, Japan

[73] Assignee: Dengen Automatic Co. Ltd., Tokyo, Japan

[21] Appl. No.: 553,394

[22] Filed: Nov. 18, 1983

[30] Foreign Application Priority Data

Dec. 10, 1982 [JP] Japan ..... 57-215503

[51] Int. Cl.[3] ..... A63F 1/12; A63F 1/14

[52] U.S. Cl. ..... 273/149 R; 273/309

[58] Field of Search ..... 273/149 R, 309

[56] References Cited

U.S. PATENT DOCUMENTS 3,899,178 8/1975 Watanabe ..... 273/149 R X 4,219,200 8/1980 Takahashi ..... 273/149 R X 4,264,074 4/1981 Sobajima ..... 273/149 R

FOREIGN PATENT DOCUMENTS 46952 4/1977 Japan ..... 273/149 R

*Primary Examiner*—Anton O. Oechsle

*Attorney, Agent, or Firm*—Wenderoth, Lind & Ponack

[57] ABSTRACT

A pai (tile) arranging apparatus for an automatic playing table for a game known by the trademark Mah-Jongg, which includes a hopper provided in the playing table, a mixing unit which includes a turntable provided in the hopper, an orientation control unit for controlling orientations of plural pais (tiles), a transferring unit for transferring the tiles, an orientation detecting unit for detecting the orientations of the tiles, and an orientation correcting unit which is operative in response to a detecting signal of the orientation correcting unit.

8 Claims, 12 Drawing Figures

TILE ARRANGING APPARATUS FOR AUTOMATIC GAME PLAYING TABLE

FIELD OF THE INVENTION

The present invention relates to a mah-Jongg playing apparatus, and more particularly to a pai arranging apparatus for an automatic Mah-jongg playing table. Mah-Jongg is a trademark for a game.

BACKGROUND OF THE INVENTION

The game of Mah-Jongg is popular throughout in the world, particularly in Asian countries such as China, Japan and Hong-Kong and the like. Mah-Jongg is usually played with a Mah-Jongg playing table and a predetermined number of Mah-Jongg pais (tiles). When Mah-Jongg is played it is first necessary to shuffle (mix) the Mah-jongg tiles, then necessary to draw up a predetermined numbers of tiles (thirteen tiles) in two rows and thereafter one row of the tiles must be heaped up the other row to form a block of tiles.

An automatic Mah-Jongg playing table has been widely used to carry out the above operations. A known pai arranging apparatus for an automatic Mah-Jongg playing table performs automatically several operations of shuffling the tiles, turning over the tiles, piling up one row of tiles on the other row, preparing four sets of piled up tiles and transferring the piled up tiles on the table for the next play.

The conventional automatic Mah-Jongg playing table comprises a shuffling member for shuffling (mixing) tiles on a tapered portion of a turntable mounted in a hopper, a tile drawing member for absorbing the turned over tiles by a magnet located at a top end of the turntable, a feeding member for feeding the absorbed tiles to a conveyer and a transferring member for transferring the turned over tiles to a waiting table for holding a block of tiles.

In this rotating ring-shaped automatic tile arranging apparatus employing a magnetic force, two kinds of attitude (orientation) correcting members in the form of nail-shaped obstacles are mounted in the hopper, and the attitude (orientation) correcting operation for turning over all tiles can be performed with the turntable by colliding the tiles with the obstacles. Accordingly, a long time interval is required to arrange the tiles whose attitudes are random, and the tiles cannot be transferred to the waiting table effectively. Further, the tiles are damaged by frictional contact when the tiles are drawn to the magnet and when they are disengaged from the magnet. The tiles initially drawn to the rotating ring are disturbed by the following tiles which are concentrated in an absorbing area of the rotating ring and thereby the attitude of the tiles are changed and the tiles are dropped from the rotating ring. Moreover, the attitude of the tiles riding on the belt-conveyer is changed by the vibration of the conveyer and leads to inconvenience in arranging the tiles.

OBJECT OF THE INVENTION

It is, accordingly, an object of the present invention to provide a Mah-Jongg pai arranging apparatus for an automatic Mah-Jongg playing table, which can perform the pai arranging operation surely and swiftly without damage.

More specifically, it is an object of the present invention to provide a pai arranging apparatus for an automatic Mah-Jongg playing apparatus, equipped with an improved attitude controlling member for controlling attitudes (orientations) of Mah-Jongg tiles and an improved attitude correcting member for correcting the tiles to the right attitude (orientation).

According to the present invention, there is provided a pai arranging apparatus for an automatic Mah-Jongg playing table which comprises a shuffling member for shuffling Mah-Jongg tiles, and four of an attitude controlling member for controlling the attitude (orientation) of the tiles by means of rotating operations of a hopper and a rotation column, a gating member for gating the tiles led from the attitude controlling member, and a transferring member for transferring the tiles led from the gating member, an attitude detecting member for detecting the attitudes (orientation) of the tiles transferred by the transferring member, and an attitude correcting member for correcting the attitude (orientation) of the tiles is responsive to a detecting signal from the attitude correcting member.

BRIEF DESCRIPTION OF THE DRAWINGS

Additional objects and advantages will become apparent upon consideration of the following description in conjunction with the accompanying drawings. In the drawings like parts in each of the several figures are identified by the same reference characters, and.

DETAILED DESCRIPTION OF THE PREFERRED EMBODIMENT OF THE INVENTION

Figure 1:
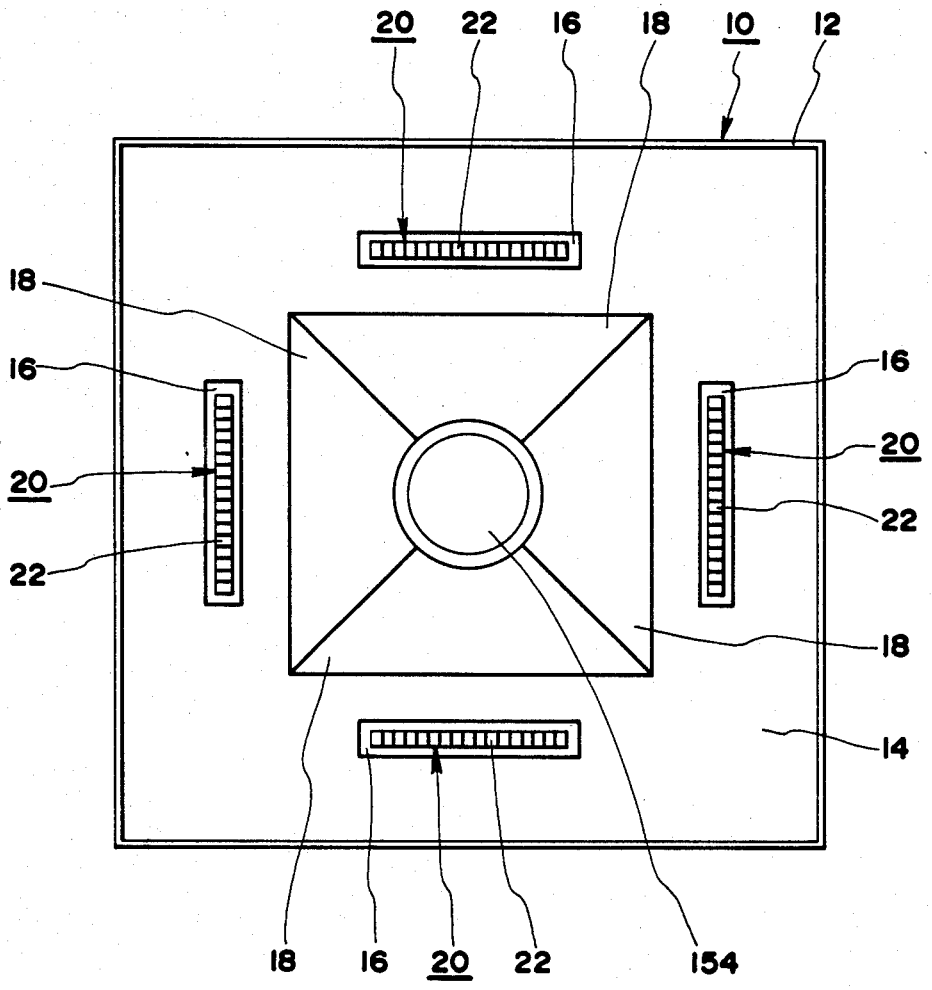
FIG. 1 is top plan view of an automatic Mah-Jongg playing apparatus employing the present invention.

Referring to FIG. 1 of the drawings, there is shown a greatly simplified automatic Mah-Jongg playing table 10 employing a pai arranging apparatus of the present invention. The automatic Mah-Jongg playing table 10 comprises, substantially, an upper frame 12, a playing plate 14 secured to the upper frame 12 and a dicebox 154 for selecting a number of dice and a pair arranging apparatus. The playing plate 14 is provided with four window plates 16 and four pivotable plates 18. Four sets of pai (tile) blocks 20 are arranged on the respective four window plates 16. Each of the four pivotable plates 18 is connected to the upper plate 14 by a hinge and is automatically rotated in a downward and inward direction of the playing plate 14 in order to drop the tiles 22 toward the lower side of the playing plate 14 after the finish of Mah-Jongg play. The tiles dropped in the table are automatically shuffled and thereafter arranged for the next play. Two sets of Mah-Jongg pai are used in the Mah-Jongg playing table.

Figure 2:
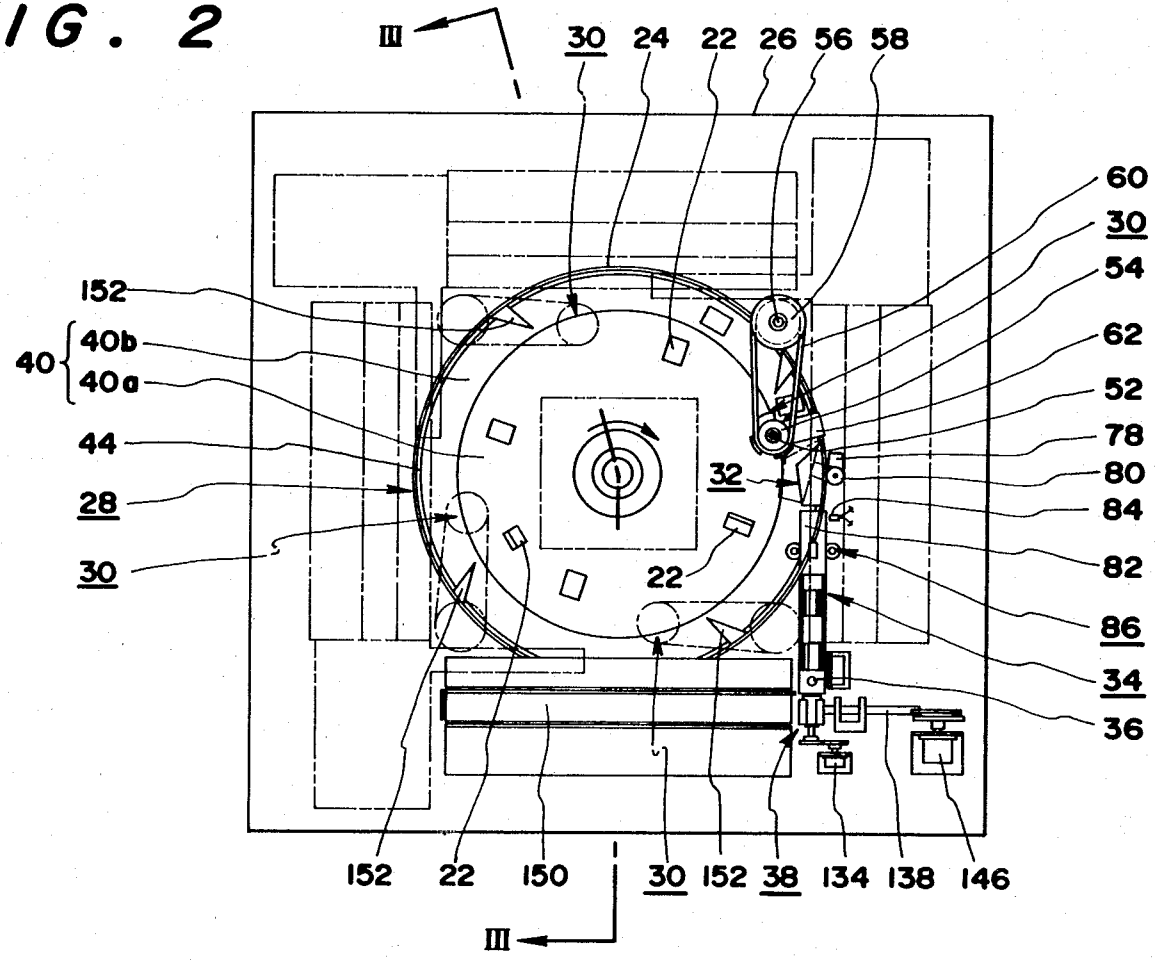
FIG. 2 is plan view of a Mah-Jongg pai arranging apparatus of an automatic Mah-Jongg playing apparatus according to the present invenion, in which an upper plate is removed therefrom.
Figure 3:
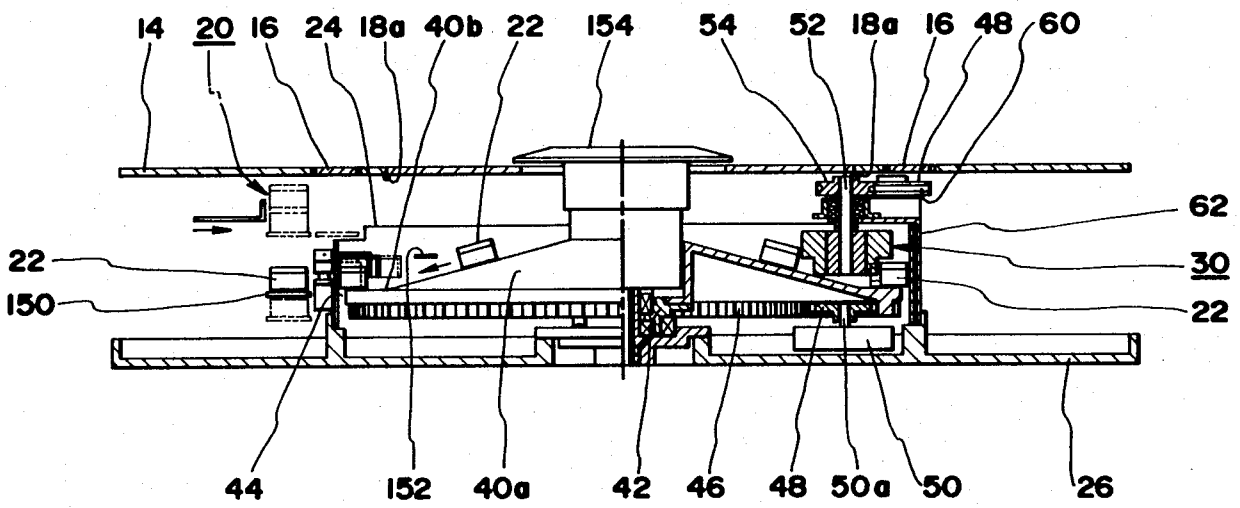
FIG. 3 is a vertical sectional view of the pai arranging apparatus for the present invention taken along line III—III of FIG. 2.

Referring now to FIGS. 2 to 9 of the drawings, there is shown a pai arranging apparatus for an automatic Mah-Jongg playing table according to the present invention. As is shown in FIGS. 2 and 3, the pai arranging apparatus comprises a hopper 24 secured at a bottom plate 26 and positioned to the lower side of the playing plate 14, a shuffling member 28 for shuffling the tiles within the hopper 24, and at each of four sides corresponding to the four window plates 16 an attitude control member 30 for controlling the (orientation) attitude of the tiles 22, a gating member 32 for changing over the direction of movement of the tiles 22 whose attitudes are controlled by the attitude control member 30, a transferring member 34 for transferring the tiles fed from the gating member 32, an attitude detecting member 36 for detecting the attitude of the tiles fed from the transferring member 34, and an attitude correcting member 38 for correcting the attitude of the tiles 22 so that a surface of each of the tiles 22 is directed toward the lower side.

The shuffling member 28 comprises a turntable 40 provided within the hopper 24. As is shown in FIG. 2, four attitude control members 30 are provided at the peripheral edge portions of the turntable 40 spaced apart equidistantly from each other. A gating member 32 is provided adjacent to and at the rear portion of each attitude control member 30 and is positioned within the hopper 24. The transferring members 34 are positioned to the outer side of the hopper 24 and communicates with the respective gating members 32. The attitude detecting members 36 are provided at an outlet side of the respective transferring members 34. The attitude correcting member 38 is are also provided at the outlet side of the respective transferring members 34.

The shuffling member 28 comprises a turntable 40 provided within the hopper 24, a first motor 50 for driving the rotating operation of the turntable 40 and gear means, as is shown in FIGS. 2 and 3.

In more detail, the turntable 40 is fastened to a supporting shaft 42 and includes a tapered portion **40*a* and a flat edge portion 40*b*. A clearance 44 is formed between an internal wall of the hopper 24 and the flat portion 40*b* of the turntable 40. A width of the clearance 44 is set so as to be smaller than any width of the tile 22. The turntable 40 can be formed from one flat plate into the tapered portion 40*a* and the flat portion 40*b*. It is, however, necessary that the tile 22 riding on the turntable 40 must be moved toward the flat edge portion 40*b* by the centrifugal force due to the rotation of the turntable 40. Accordingly, it is preferable to provide a diffusing member in the form of an elastic bar and the like on the turntable 40 in order to positively move the tile 22 toward the flat portion 40*b* of the turntable 40. As is shown in FIG. 3, an internal gear 46 is fastened to the inner side of the turntable 40. A driving gear 48 is fastened to a rotating shaft 50*a* of the drive motor 50 and engages with the internal gear 46. The rotation of the drive motor 50 is transmitted to the turntable 40 by way of the rotating shaft 50*a*, the gear 48, the internal gear 46 and the supporting shaft 42 and thereby the turntable 40** is rotated.

Figure 4:
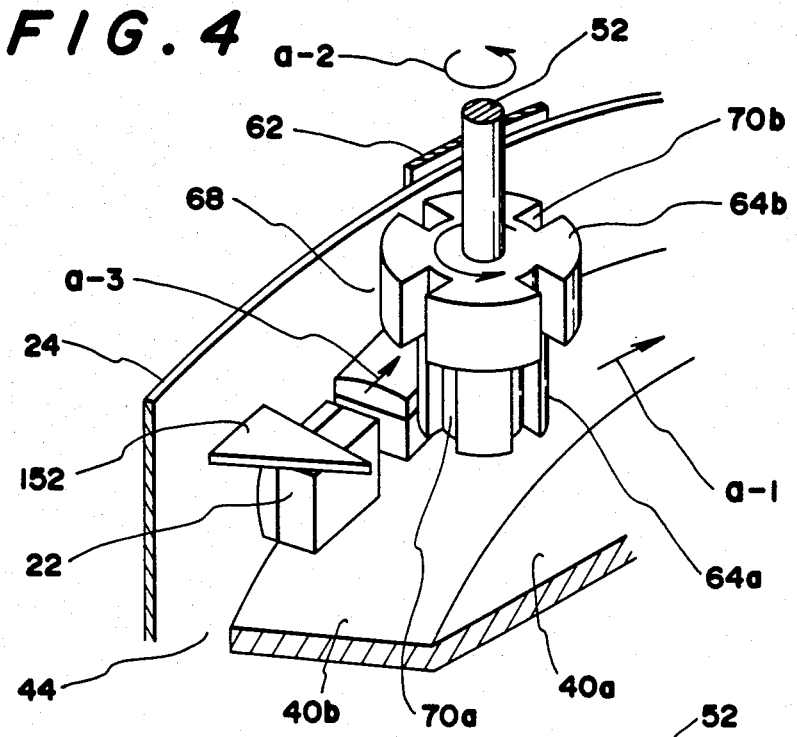
FIG. 4 is an enlarged perspective view of an attitude controling member of the pai arranging apparatus according to the present invention.
Figure 5:
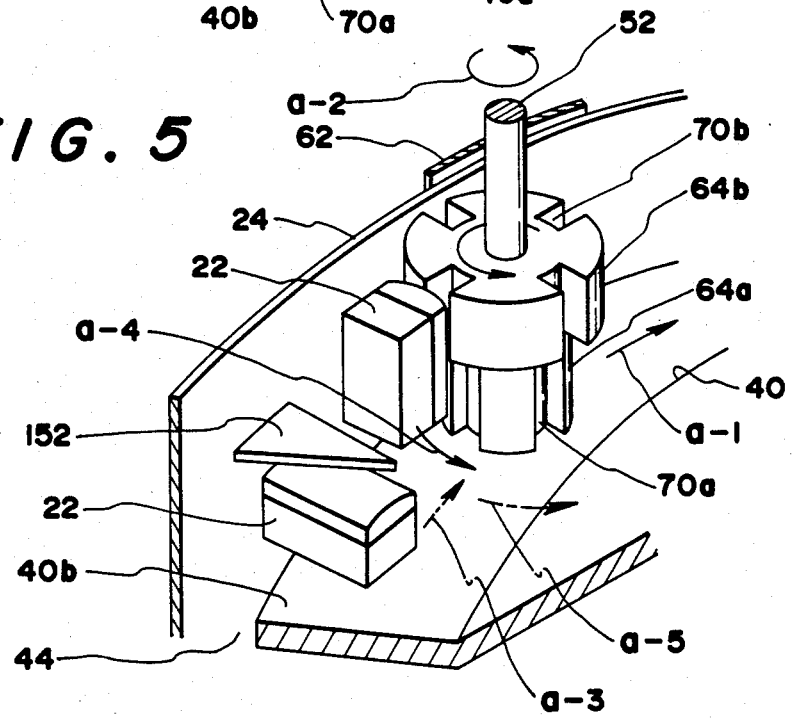
FIG. 5 is an enlarged perspective view of the attitude controlling member of the pai arranging apparatus according to the present invention.

As is shown in FIGS. 2 to 5, each attitude control member 30 comprises a shaft 52, a driven pulley 54 fastened to the shaft 52 located at the inner side of the hopper 24, a driving shaft 56 located to the outer side of the hopper 24, a driving pulley 58 secured to the driving shaft 56 and a belt 60 engaging the driven pulley 52 with the driving pulley 58. The driven shaft 52 is rotatably supported by a supporting frame 62. As is best shown in FIGS. 4 and 5, the attitude control member 30 further includes a lower column **64*a* fastened to the lower portion of the driven shaft 52, and an upper column 64*b* fastened to an upper portion of the driven shaft 52 and having a larger diameter than that of the first column 64*a*. As is shown in FIGS. 4 and 5, a distance between the inner wall of the hopper 24 and the column 64*a* forms a passage 68 to pass the tile 22. The width of the passage 68 is set so as to be slightly larger than the maximum width of the tile 22 which is directed toward its axial direction. Both of the lower column 64*a* and the upper column 64*b* are made of a gum-like material or the like. The lower and upper column 64*a* and 64*b* are, respectively provided with longitudinal slots 70*a* and 70*b*. The slots 70*a* and 70*b*** serve to perform the attitude control effectively.

Figure 6:
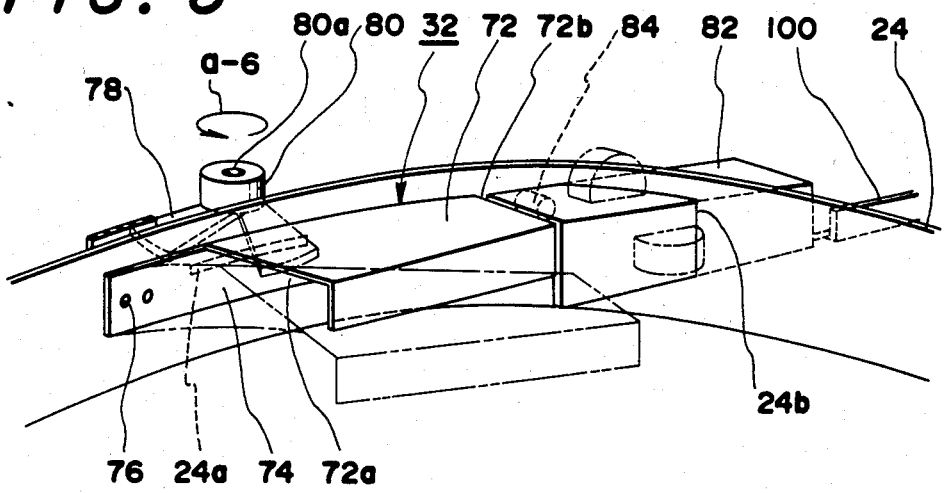
FIG. 6 is an enlarged perspective view of a gating member of the pai arranging apparatus according to the present invention.

As is shown in FIG. 6, the gating member 32 comprises a C-shaped shaped gating conduit 72 having an inlet **72*a* and an outlet 72*b* having a smaller width than that of outlet 72*a*, an outer side plate 74 opposed to the internal wall of the hopper 24 is formed by a spring plate. The side plate 74 is secured to the hopper 24 by rivets 76 and supports the gating condut 72 on the hopper 24. A rotating lever 78 is provided on the outer side of the hopper 24. The rotating lever 78 is fastened to a rotation shaft 80*a* of a motor 80 so as to be projectable into the hopper 24 through an aperture 24*a* provided in the wall of the hopper 24. When the lever 78 projects into the hopper 24, the lever 78 presses the conduit 72 toward the inner side of the hopper 24 and changes over the direction of movement of the tile 22**.

Figure 7:
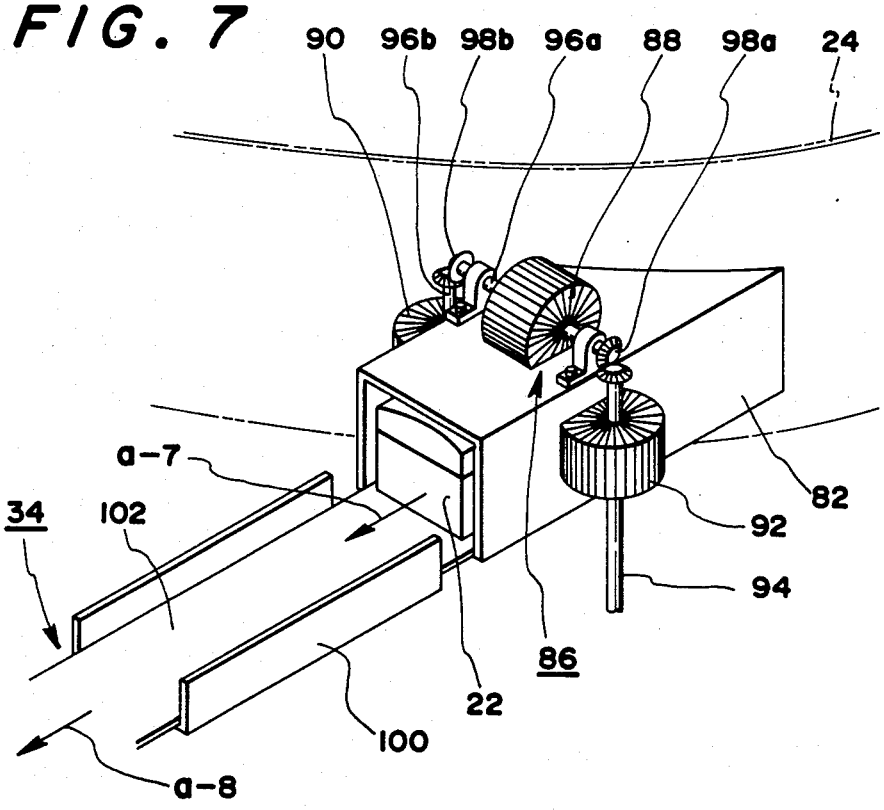
FIG. 7 is an enlarged perspective view of a transferring member of the pai arranging apparatus according to the present invention.

As is shown in FIGS. 6 and 7, the transferring member 34 comprises a guiding conduit 82 connected to the outlet **72*b* of the gating conduit 72. At sensor 84 provided in an inlet portion of the guiding conduit 82, and a brushing unit 86. The sensor 84 detects the number of the tiles 22 which pass through the gating conduit 72. The brushing unit 86 is provided with rotating brushes 88, 90 and 92 at the outer peripheral sides of the guiding conduit 82. The rotating brush 88 is located at an upper side of the guiding conduit 82 so as to be projected into the guiding conduit 82. The brushes 90 and 92 are provided on the respective side surfaces so that portions thereof are projected into the guiding conduit 82. Each of the brushes 88, 90 and 92 is constructed by covering a roller with hair. A driving shaft 94 of the brush 92 is connected to a motor (not shown in the drawings) to revolve the brush 92. The rotation of the brush 92 is transmitted to the brushes 88 and 90 by way of bevel gears 98*a* and 98*b* and shafts 96*a* and 96*b*. The rotations of the brushes 88, 90 and 92 serve the functions of cleaning the tile 22 and of moving the tile 22**.

Figure 8:
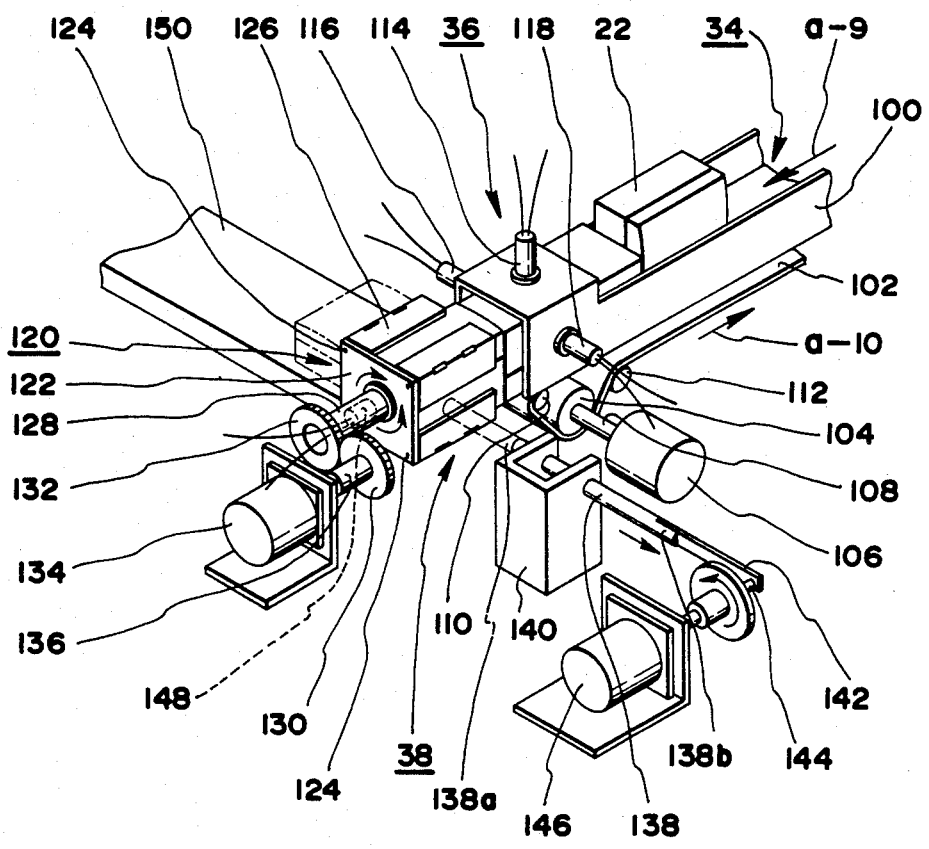
FIG. 8 is an enlarged perspective view of an attitude correcting member of the pai arranging apparatus according to the present invention.

As is shown in FIGS. 7 and 8, the transferring member 34 further comprises a surrounding frame 100 which is connected to an outlet side of the guiding conduit 82, and a belt-conveyor 102. The belt of the belt-conveyer 102 is driven by a driving roller 104, over guide rolls 110 and 112 powered by a drive motor 106. The driving roller 104 is connected to a rotating shaft 108 of the drive motor 106. The attitude detecting member 36 is provided with sensors 114, 116 and 118 which are located to an outlet side of the transferring member 34. The sensor 114 is mounted on an upper wall of the surrounding frame 100 and the sensors 116 and 118 are mounted on the respective side walls of the surrounding frame 100.

As is best shown in FIG. 8, the attitude correcting member 38 is provided in the outlet side of the transferring member 34 and comprises, substantially, a rotatable basket 120, an attitude correcting motor 134 and a feeding member including a feeding motor 146, a connecting rod 142 and a feeding rod 138. The rotatable basket 120 is provided such that an open end thereof opposes an outlet of the frame of the transferring member 34 and comprises supporting plates 126 and an end plate 122. Supporting shafts 124 are secured on the corners of the end plate 122. Each of the supporting plates 126 is pivotably mounted on each of the supporting shafts 124 and is formed by two plates which are rotatable by springs mounted on the supporting shaft 124 and is positioned so as to be usually closed as is shown in FIG. 8. Each of the supporting plates 126 is pressed by the tile toward the outer side of the basket 120 and is thereby rotated when the tile is inserted into the basket 120. The basket 120 is rotatably supported by a rotational shaft 128 of which one end is secured to the end plate 122. The other end of the shaft 128 is connected to a rotating shaft 136 of the motor 134 by way of transmission gears 130 and 132. The feeding rod 138 of the feeding member is slidably supported by a support 140. The feeding member also includes, a crankshaft 144 connected to an end portion 138*b* of the feeding rod 138 by a connecting rod 142 and driven by the feeding motor 146.

In operation, the turntable 40 is rotated by the drive motor 50. The rotation of the drive motor 50 is transmitted to the turntable 40 by way of the gear 48 and the internal gear 46, as is shown in FIGS. 2 and 3. A set of the tiles 22 in the hopper 24 is shuffled by the rotation of the turntable 40. In more detail, the tiles 22 ride on the tapered portion 40*a* of the turntable 40 are moved toward the flat portion 40*b* by the centrifugal force due to the rotation of the turntable 40. The tiles 22 on the flat portion 40*b* are shuffled (mixed) by the internal surface of the outer peripheral wall of the hopper 24 and the rotation of the turntable 40.

As is shown in FIGS. 2 to 3, the rotation of the driving pulley 48 is transmitted to the driven pulley 54 by way of the belt 60. In this case, the driven pulley 54 is rotated to a counter-direction with respect to the rotating direction of the turntable 40. By the rotation of the driven pulley 54, the lower and the upper columns 64*a* and 64*b* are rotated in counterclockwise direction as is shown by an arrow a-2 of FIG. 4. The revolutions of the turntable 40 and the column 64*a* make the tiles 22 pass through the passage 68. The lower column 64*a* corrects the attitude of end tile 22 so as to be directed longitudinally on either its side or its bottom surface. Further, as is illustrated in FIG. 5, the upper column 64*b* serves to remove tiles 22 which are standing on the flat portion 40*b* toward the central side of the turntable 40 and to throw down the standing tiles 22, and thereby the attitude control can be reliably performed with the aid of the slots 70*a* of the lower column 64*a* and the slots 70*b* of the upper column 64*b*.

The tile 22 is fed to the gating conduit 72 of the gating member 32 through the passage 68. The tile 22 is then further fed to the guiding conduit 82 of the trnsferring member 34. In the transferring member 34, the sensor 84 senses the number of tiles which are inserted into the guiding conduit 82. When the number of tiles led into the guiding conduit 82 attains a predetermined value, the motor 80 is rotated in response to a detecting signal of the sensor 84. By the rotation of the motor 80, the lever 78 is rotated to press the gating conduit 72 toward the internal side of the hopper 24 and thereby the the tile 22 is directed to prevent the insertion of the tile 22 into the guiding conduit 82. The tile 22 inserted into the guiding conduit 82 is moved and cleaned by the rotation of the brushing unit 86. The tile 22 is then further fed to the belt-conveyor 102 which conveys the tile 22 toward the attitude correcting member 38.

At the end portion of the transferring member 34, the attitude detecting member 36 detects the attitude of the tile 22. The attitude detecting member 36 employs the sensors 114, 116 and 118, each of which detects either optically or magnetically. In the case of using a magnetic sensor, it is necessary to imbed a confirming element in the form of a magnet or iron to the tile 22. Detecting signals from the attitude detecting member 36 are supplied to the attitude correcting motor 134 of the attitude correcting member 38 and thereby the attitude of the tile is corrected as described specifically hereinafter and as illustrated in FIGS. 9A to 9D.

As is best shown in FIG. 8, the rotatable basket 120 is positioned to the outlet side of the surrounding frame 100 such that the inlet of the basket 120 opposes the outlet of the surrounding frame 100. The tile 22 is fed from the transferring member 34 to the rotatable basket 120. The rotational shaft 128 of the basket 120 is a cylindrical tube. A sensor 148 for detecting a tile 22 inserted in basket 120 is mounted to the rotation shaft 128. When the tile is inserted into the basket 120, a detecting signal is supplied to the control unit and the rotation of the attitude correcting motor 134 is controlled as described specifically hereinafter.

FIGS. 9A to 9D show modes of the detecting operation of the attitude detecting member 36. The colours of the face and both of sides of the tile 22 are generally white and the colour of the reverse side of the tile 22 is generally black or brown. In FIGS. 9A to 9D, reference characters a, b and c show intensities of reflected light which is reflected from the tile 22 to the sensors 114, 116 and 118.

Figure 9A:
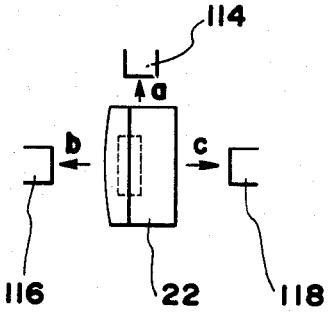
FIGS. 9A to 9D are views showing operations of the pai arranging apparatus according to the present invention.
Figure 9B:
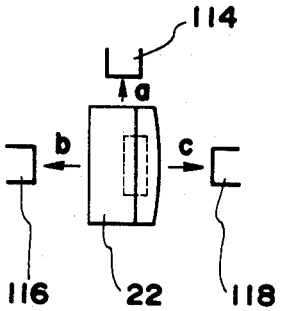
Figure 9C:
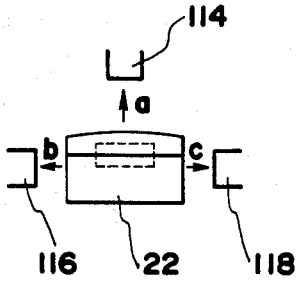
Figure 9D:
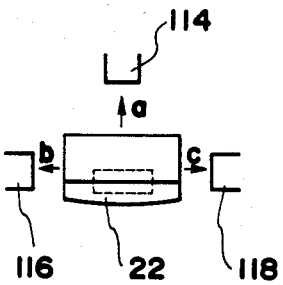

As is shown in FIG. 9A, when the tile 22 is positioned so that the face opposes the sensor 118 and the reverse side opposes sensor 116, the equation $a=c\neq b$ is obtained. A photo-electric converting element is employed as each of the sensors 114, 116 and 118. When the equation $a=c\neq b$ is obtained, the electric control unit is set to control the motor 134 so as to be rotated 90 degrees in the clockwise direction and thereby the rotation basket 120 is rotated 90°. When the tile 22 is placed such that the face is directed toward the sensor 116 and reverse side is opposed to the sensor 118 as is shown in FIG. 9B, the equation $a=b\neq c$ is obtained and thereby the motor 134 is rotated 90 degrees in the counterclockwise direction by the electrical signal from the electric control unit and the rotation basket 120 is rotated to correct the attitude of the tile. When the tile 22 is positioned such that the face faces downward away from sensor 114, the equation $b=c\neq a$ is obtained as is shown in FIG. 9C, the electric control device is set so as not to supply the electrical signal to the attitude correcting motor 134. When the tile 22 is positioned so that the face opposes the sensor 114 as is shown in FIG. D, the electric control unit is set to output the electric signal in order to control the attitude correcting motor 134 so as to rotate the rotatable basket 120 through 180 degrees.

The feeding motor 146 is rotated after the attitude correcting motor 134 stops operation by a detecting signal from the sensor 148. The rotation of the feeding motor 146 is transmitted to the reciprocal operation of the feeding rod 138 by way of the connecting rod 142 to direct the tile from the rotatable basket 120 to the waiting platform 150. The rotating operation of the feeding motor 146 is in synchronism with the rotating operation of the attitude correcting motor 134.

As is described in the foregoing, the one set of tiles is dropped on the turntable 40 after finishing the game and is shuffled. The standing tiles 22 are thrown down (tipped over) by the upper column **64*b* of the attitude control member 30 and moved toward the tapered portion 40*a*. The tile 22 in the flat portion 40*b* of the turntable 40 is directed to the longitudinal direction by means of the lower column 64*a* of the attitude controlling member 30 and thereafter is transferred toward the attitude correcting member 38 by way of the transferring member 34. The tile 22 transferred to the attitude correcting member 38 is corrected such that the reverse side of the tile 22 faces up. In this case, the sensor 84 provided on the inlet portion of the guiding conduit 82 of the transferring member 34 detects the number of the tiles 22 passing through the conduit 82 and supplies the detecting signal to the motor 80 to operate the gating unit, when the predetermined number of the tiles 22 have passed through the conduit 82. By the operation of the gating unit, further tiles 22 are guided away from the conduit 82**.

Additionally, the attitude detecting member 36 can be comprised of only one sensor, the sensor 114 which detects the tile of which the face is directed upper direction, when means for throwing down standing tiles and means for correcting the attitude of side ways turned tiles are provided in the attitude control member 30. The upper column **64*b* is unnecessary in the attitude controlling member 30 to simplify the control mechanism, when the obstacle 152 is provided on the hopper 24 as is shown in FIGS. 4 and 5 in order to tip over the tile 22**. Moreover, each of the control members is operated and synchronized by sequentially controlling the control members.

According to the present invention, the time duration required to direct tiles from the turntable is shortened, since it is only necessary to throw down standing tiles and to control the attitudes of the tiles.

Further, according to the present invention, the attitude correcting operation for correcting attitudes of the tiles can be mechanically performed securely and swiftly to form blocks on waiting platforms placed at four positions, so-called east, west, south and north positions of a Mah-Jongg playing table.

In view of the above, it will be seen that the several objects of the invention are achieved and other advantages are attained.

While a preferred embodiment of the invention has been shown and described, it will be apparent to those skilled in the art that modifications can be made within the scope of the invention which is defined in the appended claims. Accordingly, the foregoing embodiment is to be considered illustrative, rather than restrictive of the invention and those modifications which come within the meaning and range of equivalency of the claims are to be included therein.

What is claimed is:

1. A game tile arranging apparatus for an automatic game playing table, comprising:

a hopper provided in the table;

a mixing member for mixing the tiles, rotatively disposed within said hopper for rotation about a rotational axis;

an orientation controlling member, having an inlet and an outlet, for controlling the orientations of the tiles, said orientation controlling member including means, rotatable in a different direction than said mixing member, for rotatively engaging the tiles in said hopper between said inlet and said outlet;

orientation detecting means, responsive to the orientation of tiles at a first location outside said hopper, for providing a first signal indicative of the orientation of the tiles at said first location;

means, responsive to said first signal, for correcting the orientations of the tiles whose orientations are detected by said orientation detecting means;

means for receiving and transferring tiles at a second location in said hopper to said first location outside said hopper;

sensor means, responsive to the number of tiles received by said receiving and transferring means, for providing a second signal indicative of said number;

means for directing tiles from said outlet of said orientation controlling member to said second location; and gating means, having an inlet portion adjacent said outlet of said orientation controlling member and responsive to said second signal, for alternatively directing tiles from said outlet to said second location or gating the tiles at said outlet away from said second location so as not to be received and transferred by said receiving and transferring means.

2. An apparatus as in claim 1, wherein said mixing member comprises a turntable rotatably provided within said hopper and having a tapered portion and a flat portion integrally formed at an outer peripheral portion of said tapered portion.

3. An apparatus as in claim 1, wherein said hopper has a peripheral wall, said orientation controlling member including at least one rotatable column provided within said hopper spaced a predetermined distance form said wall to form a passage of width larger than the maximum width of the tiles.

4. An apparatus as in claim 1, wherein said hopper has an outer peripheral wall, said gating means including a gating conduit rotatably mounted on said wall, means, including a pressing lever, engagable with said gating conduit, for pressing and rotating said gating conduit, and a motor for actuating said pressing lever.

5. An apparatus as in claim 1, wherein said receiving and transferring means comprises a guiding conduit positioned outside of said hopper and communicating with said gating means, and a conveying means for conveying the tiles from said guiding conduit and including a conveyor communicating with said guiding conduit.

6. An apparatus as in claim 5, wherein said transferring member further comprises a brushing unit for cleaning and moving the tiles in said guiding conduit, said brushing unit including at least one brush rotatably mounted on said guiding conduit.

7. An apparatus as in claim 1, wherein said orientation detecting means comprises at least one sensor for detecting the orientation of the tiles.

8. An apparatus as in claim 1, wherein said receiving and transferring means has an inlet side and an outlet side, said orientation correcting means comprising a rotatable basket located at said outlet side, and an orientation correcting motor responsive to said first signal and couplable with said rotatable basket for rotating said rotatable basket to rotate the tile to a correct orientation, said orientation detecting means including a sensor for detecting a tile inserted into said basket, said apparatus further comprising feeding means for feeding the inserted tile from said orientation correcting means after the inserted tile is in a correct orientation, said feeding means including a feeding motor and a feeding bar reciprocally movably coupled to said feeding motor and engagable with the tile in said basket for pushing the inserted tile out of the basket.

* * * * *